US005410321A

United States Patent [19]

Gordon et al.

[11] Patent Number: 5,410,321

[45] Date of Patent: Apr. 25, 1995

[54] DIRECTED RECEPTION PATTERN ANTENNA

[75] Inventors: Eldon L. Gordon, Sachse; Henry S. Eilts, Plano; John P. Volpi, Garland, all of Tex.

[73] Assignee: Texas Instruments Incorporated, Dallas, Tex.

[21] Appl. No.: 128,943

[22] Filed: Sep. 29, 1993

[51] Int. Cl.[6] ..... H01Q 3/02; H01Q 3/12

[52] U.S. Cl. ..... 342/374

[58] Field of Search ..... 342/374, 16, 17; 455/277.1, 277.2

[56] References Cited

U.S. PATENT DOCUMENTS

| | | | |
|---|---|---|---|
| 3,530,485 | 9/1970 | Radford . | |
| 3,531,803 | 9/1970 | Rosen et al. . | |
| 3,680,113 | 7/1972 | Dorier et al. . | |
| 3,922,685 | 11/1975 | Opas . | |
| 4,924,235 | 5/1990 | Fujisaka et al. | 342/374 |
| 5,027,125 | 6/1991 | Tang | 342/368 |

*Primary Examiner*—Theodore M. Blum

*Attorney, Agent, or Firm*—René E. Grossman; Richard L. Donaldson

[57] ABSTRACT

An antenna system and method comprising an antenna having 2+N antenna elements, where N is zero or an odd integer, an algorithm controlled switching circuit having a separate switch associated with each of the elements and a switch control selectively causing the switching circuit to couple an adjacent pair of the antenna elements to their associated switches while maintaining the remaining switches uncoupled from their associated antenna elements. The algorithm controlled switch control includes circuitry for successively coupling each adjacent antenna element pair of the antenna elements to their associated switches, determining a predetermined parameter for each of the antenna element pair and then causing the antenna system to operate with only one of the antenna pairs responsive to determination of the predetermined parameter. The centers of all of the antenna elements are directed in one or the other of two opposite directions and the center of each of the antenna elements is disposed at a different vertex of an equilateral polygon having N sides.

12 Claims, 4 Drawing Sheets

DIRECTED RECEPTION PATTERN ANTENNA

BACKGROUND OF THE INVENTION

1. Field of the Invention

This invention relates to an antenna array and system for minimizing the effects of jamming by nulling the received signal from the direction of the jamming signal.

2. Brief Description of the Prior Art

The power from signal jammers at the input to a global positioning system (GPS) receiver presents a severe limitation on the performance of the receiver-containing system. The prior art low cost fixed reception pattern antenna (FRPA) system provides no protection from the jammer power. Presently, the only antenna method used to reduce the power of the jamming signal at the GPS receiver is the controlled reception pattern antenna (CRPA) system. The CRPA is an adaptive antenna array driven by an algorithm and based upon feedback which minimizes the total jammer power received. In the CRPA, all of the multiple antenna elements are always active with complex electronic circuits providing the directionality or pointing of the antenna array. However, there is no known prior art relating to an intermediate level of jammer power reduction which provides jammer noise reduction approaching that of the CRPA at costs approaching that of FRPA.

SUMMARY OF THE INVENTION

In accordance with the present invention, there is provided a novel antenna system which is a directed reception pattern antenna (DRPA) system and furnishes a level of performance between the FRPA and the CRPA, providing substantial jammer noise reduction (nulling) in comparison with the FRPA antenna at a cost which is very much less than a CRPA and approaches the cost of the FRPA. In addition to cost, the antenna system of the present invention (DRPA) provides the benefits of much smaller antenna size and volume as well as lower weight and power consumption as compared with the CRPA. The DRPA incorporates a simple microwave circuit including one or more delay lines, switches and a switch controller. If all antenna elements are electrically identical, a single delay line can be used. If the antenna elements are electrically different, multiple delay lines may be required. For example, mounting the antenna elements on a non-planar surface may cause the antenna elements to be electrically different at a given aspect angle.

With a five element antenna array, for example, a pattern null can be placed in 36° increments on the antenna array horizon with crossover points at about 0.22 dB. When commanded by the receiver, the algorithm in the switch control circuit steps a null into each of the ten positions sequentially and tests and records the noise power output of the GPS receiver at each position. The antenna element pair at the position which has the lowest noise power received is selected and then receiver acquisition is accomplished. This process is repeated when the GPS receiver carrier to noise ratio ($C/N_o$) output degrades to a predetermined level or until the algorithm starts another stepping cycle of operation to locate the null position with minimum noise. If no jammer is present and no jamming signal appears at the GPS receiver input, the array can be switched to a single element (FRPA) configuration to provide 360° coverage.

Typically, there may be multiple jammers in the field which are not of equal strength, but are variable, based upon offset distance or otherwise. The antenna system of the present invention is effective against the strongest jamming signal received when there are multiple jammers in the field and will continuously update to null the strongest jammer signal. Also, sometimes multiple jammers are located at approximately the same aspect angle. In this case, the nulling can be effective against multiple jammers.

The antenna system of the present invention uses a multi-element antenna array having an odd number of antenna elements (i.e. 3, 5 or 7 elements) (with 7 probably being the upper practical limit though there is no theoretical limit) or a two element array. However, only two adjacent elements of the multi-element array are used at any one time. Adjacent elements are spaced approximately $\frac{3}{8}$ free space wavelengths apart at 1,401 GHz frequency. This spacing is critical to achieve the required cardioid pattern shape that places a pattern null in the direction of the jammer but retains high gain elsewhere. Non-adjacent pairs cannot be used because they will not yield the required cardioid shaped pattern. If the time spacing between elements is set, for example, to 0.2585 nanoseconds, the cardioid pattern for the antenna at an antenna frequency $L_1$ (1,575 GHz) and an antenna frequency $L_2$ (1,227 GHz) are uniformly offset from the single element gain at the point opposite the null. The number of end-fire nulls which can be directed by the antenna array is two times the number of elements, one in each direction for each adjacent antenna element pair. An odd number of elements must be used because an even number of elements produces ambiguous, parallel directed nulls. An exception is a two element antenna array where nulls can be directed forward and backward.

The GPS receiver or the switch control controls the DRPA by stepping the antenna array through all of the null positions by activating all of the possible adjacent antenna element pairs in some predetermined order and measuring the noise power at each null position. The null position yielding the lowest jammer noise power is selected. This state is held until the receiver algorithm repeats the stepping sequence or until the noise level has reached some predetermined minimum level.

The advantages of the system in accordance with the present invention over the CRPA are that the implementation is relatively low cost, low weight, low power consumption and low volume. The system of the present invention has no spurious nulls which can reduce the antenna pattern gain in directions other than toward the jammer location. Also, the algorithm to operate the system of the present invention is very simple and can be programmed in the GPS receiver computer or in the switch control. The system of the present invention operates on the jammer which presents the highest power to the receiver. However, if other jammers are located within the nulled region, they will also be reduced. In practice, it can be expected that multiple jammers will not present equal power to the GPS receiver and the effect of this system is to continuously update on the strongest jammer signal.

The sacrifices introduced by the system in accordance with the present invention are that the system produces a single nulled region and is not effective against jammers that are outside of the nulled region.

Also, the width of the nulled region is approximately 60° which is relatively wide compared to a CRPA array where all antenna array elements are utilized to produce the nulls. However, 79% of the upper hemisphere remains within 3 dB of the gain of a FRPA configuration. The system will not simultaneously produce deep nulls in multiple directions as will a CRPA.

DESCRIPTION OF THE PREFERRED EMBODIMENT

Figure 1:
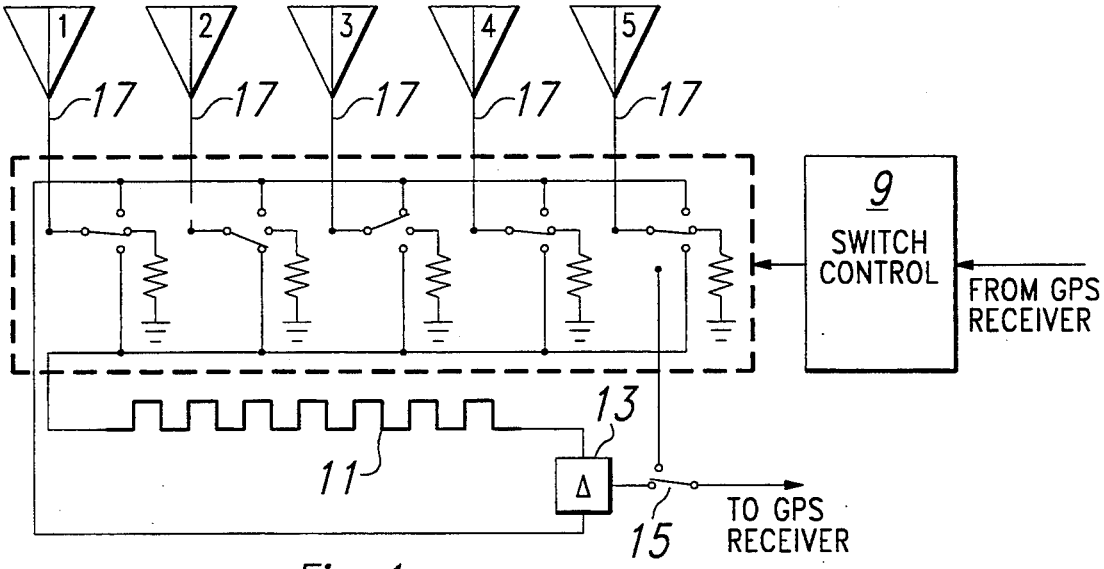
FIG. 1 is a DRPA circuit of a first embodiment in accordance with the present invention.

With reference to FIG. 1, a DRPA circuit is provided in accordance with the present invention by forming an antenna having five antenna elements 1 to 5, the number of antenna elements being arbitrarily chosen as the preferred embodiment. Other antennas having an odd number of elements will function equally well, however the minimum null depth will be affected, depending upon the number of elements used. A switching circuit 7 is provided for switching on a single pair of adjacent ones of the antenna elements via lines 17 from each of the switches of the switching circuit to its associated antenna element. The switch circuit may also contain the algorithm to operate the DRPA. The lines 17 are designed to provide equal delay for a signal travelling from any one of the antenna elements to its associated switch in the switching circuit 7. If the antenna elements 1 to 5 are electrically different, appropriate delay may be required in the lines 17 so that the delay from each antenna element to its respective switch element is equal. The switch elements of the switching circuit 7 are under the control of a switch control circuit 9 which, in turn, is controlled by signals received from a standard GPS receiver (not shown). Antenna elements 2 and 3 are arbitrarily shown as having been switched to the "on" position whereas antenna elements 1, 4 and 5 are shown in the a neutral position and terminated in a matched load or 50 ohms in the preferred embodiment. The switching can be reversed to invert the phasing of the antenna by 180°. This is accomplished by, for example, reversing the positions of the switches associated with the antenna elements 2 and 3. A 0.2585 nanosecond delay line 11 is placed in the circuit between all of the switches of the switching circuit 7 and a delta circuit 13 to set the time spacing between antenna elements and provide the cardioid pattern for the antenna at an antenna frequency $L_1$ (1.575 GHz) and an antenna frequency $L_2$ (1.227 GHz) which are uniformly offset from the single element gain at the point opposite the null. The delta circuit 13, which receives inputs from the delay line 11 and the switches of the switching circuit 7 are a 180° hybrid which is a difference summer wherein it reverses the phase of one of the two inputs thereto and then adds the two inputs, for example, providing no output for inputs thereto of equal phase and amplitude. This provides a null across the entire frequency range from $L_1$ to $L_2$. The switch 15 disconnects all but antenna element 5 from the GPS receiver in its upper position and permits antenna element 5 to be connected directly to the GPS receiver in the upper position. In its lower position, the switch 15 connects the output of the delta circuit 13 to the GPS receiver. This provides the possibility of a single element antenna, FRPA, which can be used when no jamming is present, resulting in a null-free system.

Figure 2:
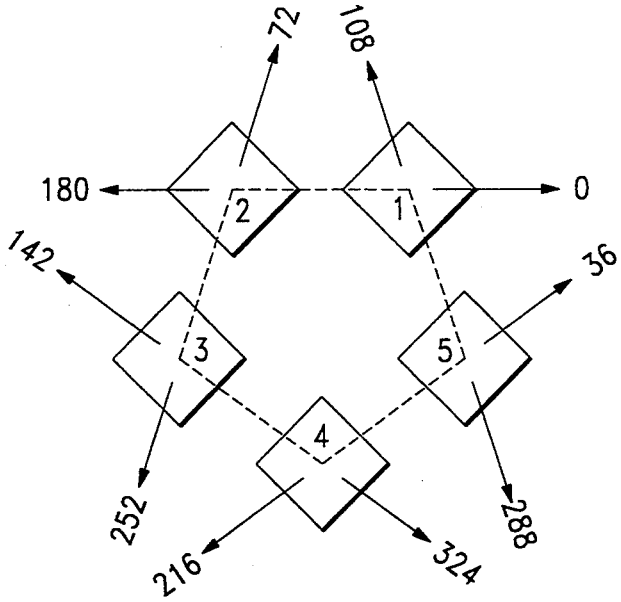
FIG. 2 is a typical five element antenna array in accordance with the present invention.
Figure 3:
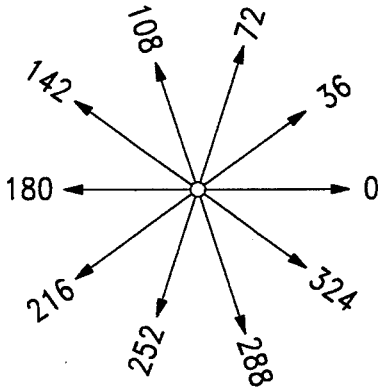
FIG. 3 shows the possible null directions of the antenna array of FIG. 2.
Figure 4:
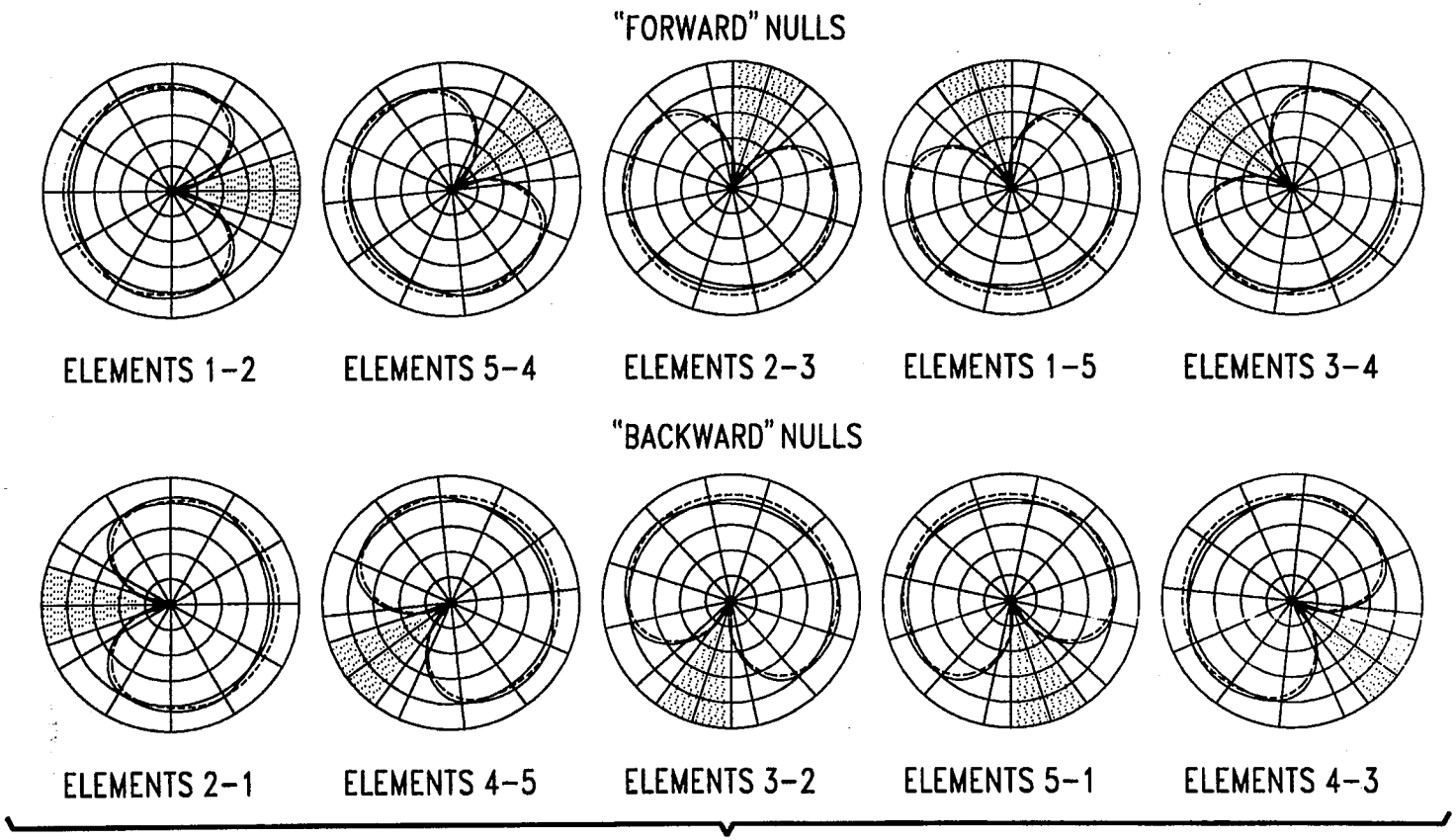
FIG. 4 shows the ten positions of the directed null and the antenna pattern for each of the ten positions in the case of the five element array of FIG. 2.
Figure 5:
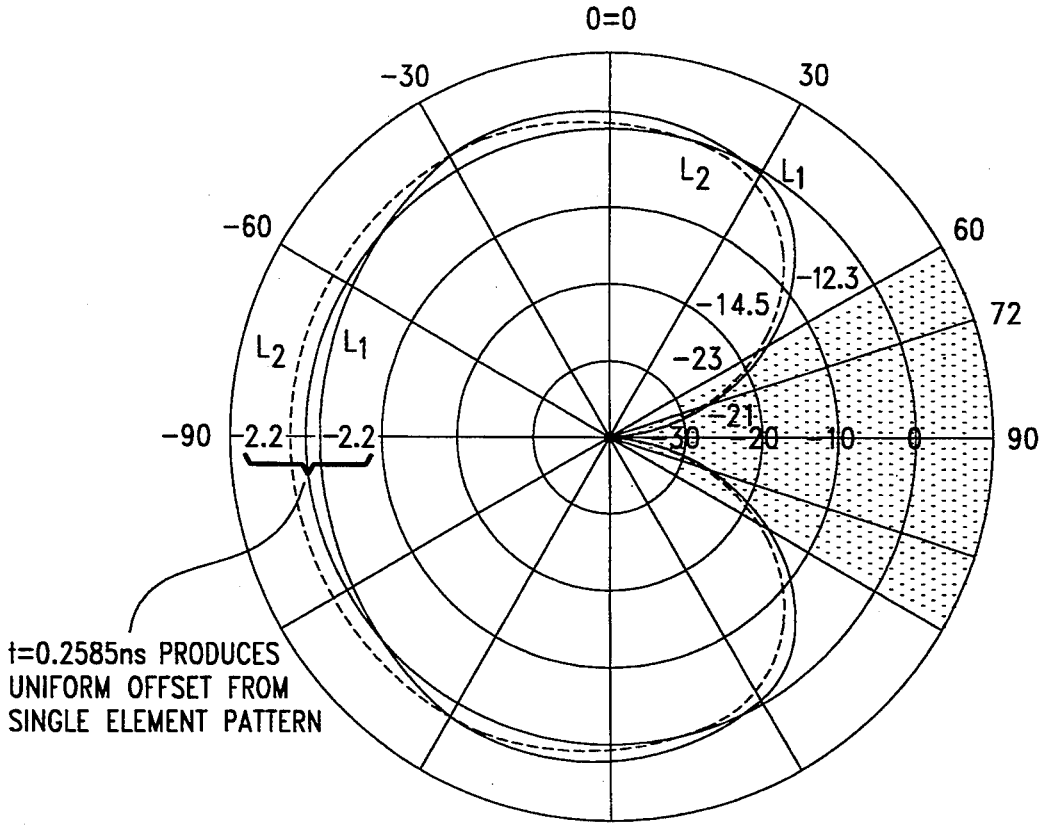
FIG. 5 shows the antenna array pattern for two adjacent active elements for a three element array and for a five element array.

Referring now to FIG. 2, there is shown a typical antenna array in accordance with the present invention when a five element antenna array is to be provided. Each of the antenna elements 1 to 5 is positioned with the center point of each antenna disposed at a vertex of an equilateral pentagon. For an N-element array the center will be at the vertex of an equilateral polygon of N sides. In the case of the parameters of the embodiment of FIG. 1 as noted above, each side of the pentagon is 3.04 inches, it taking 0.2585 nanoseconds for a wave in free space to travel that distance. The lines through the center of each antenna are all directed in one or the other of two opposite directions. With an antenna array as shown in FIG. 2, the possible null directions are 36° apart as shown in FIG. 3, there being ten possible null directions. The ten positions of the directed null and the cardioid antenna pattern for each of the ten positions in the case of the five element array of FIG. 2 is shown in FIG. 4. The antenna array pattern for two adjacent active elements in a three element array and in a five element array is shown in FIG. 5. It can be seen that the five element array is more confined in that its cone has a smaller solid angle than does the three element array.

Figure 6:
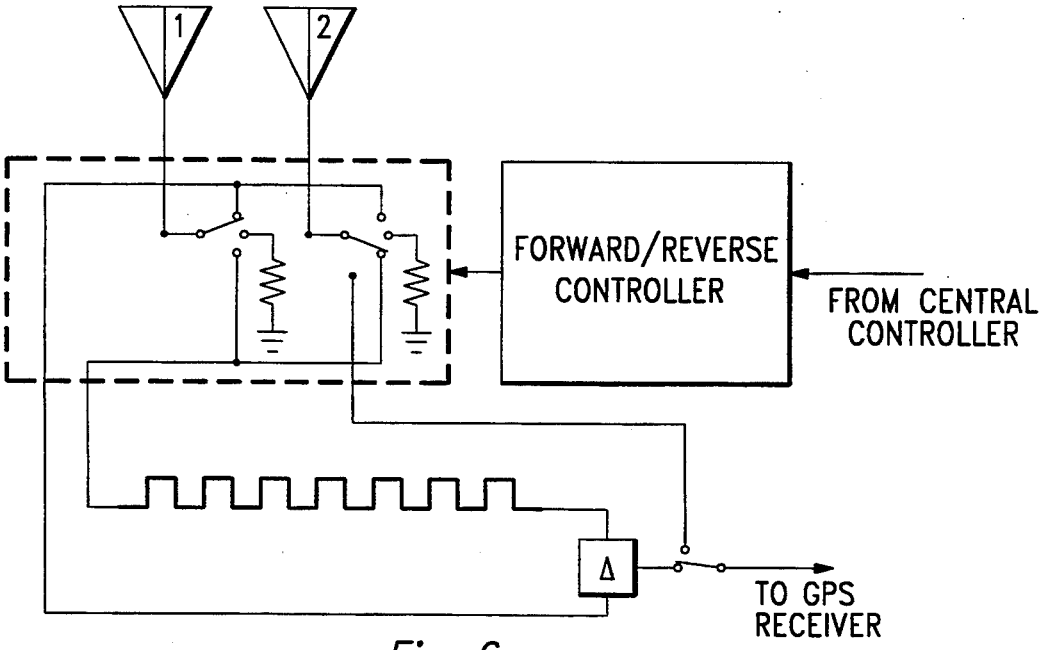
FIG. 6 is a DRPA circuit using a two element antenna array.

Referring now to FIG. 6, there is shown a circuit diagram of the one exception to the requirement that an odd number of antenna elements be provided. The one exception is the use of two antenna elements wherein antenna elements 1 and 2 are coupled as shown to provide a null in a first direction and are coupled with the switch element of the switch assembly 3 coupled to antenna element 1 in the lowermost position and the switch element coupled to antenna element 2 in the uppermost position to provide a null in a direction opposite to the first direction. The forward/reverse controller 7 determines the direction of the null of the antenna system. The delay 9 and delta circuit 11 are the same as in FIG. 1. The system can be converted to a FRPA as in the embodiment of FIG. 1 by coupling the switch 13 in the uppermost position with the antenna element 2 coupled to the lowermost position of its switch element and the antenna element 1 coupled to the central load position of its associated switch element.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. An antenna control system for selectively coupling the antenna elements of a single antenna having plural antenna elements to a receiver comprising:

(a) an antenna having 2+N antenna elements, where N is one of zero or an odd integer;

(b) a switching circuit having a plurality of switches, each of said switches being connected to an associated different one of said antenna elements; and (c) a switch control circuit for causing said switching circuit to connect a selected single adjacent pair of said antenna elements to a receiver while maintaining any remaining antenna elements unconnected to the said receiver;

d) wherein said switch control includes circuitry for successively coupling each adjacent antenna element pair of said antenna elements to their associated switches, determining a predetermined parameter for each of said antenna element pair and then causing said antenna system to operate with only one of said antenna pairs responsive to determination of said predetermined parameter.

2. A system as set forth in claim 1 wherein said antenna has an odd number of antenna elements.

3. The system of claim 1 wherein said noise parameter is jamming noise.

4. The system of claim 2 wherein said noise parameter is jamming noise.

5. The system of claim 2 wherein each of said antenna elements is of square shape, a diagonal of each of said elements being directed in the same direction.

6. The system of claim 4 wherein each of said antenna elements is of square shape, a diagonal of each of said elements being directed in the same direction.

7. The system of claim 2 wherein the time delay of a signal passing from one of said antenna elements to the switch connected thereto is substantially the same for each of said antenna elements.

8. The system of claim 5 wherein the time delay of a signal passing from one of said antenna elements to the switch connected thereto is substantially the same for each of said antenna elements.

9. The system of claim 5 wherein said antenna has M antenna elements, where M is a predetermined odd integer greater than 1, and the intersection of said diagonals of each of said antenna elements is disposed at a different vertex of an equilateral polygon having M sides.

10. An antenna control system for selectively coupling the antenna elements of a single antenna having plural antenna elements to a receiver comprising:

(a) an antenna having 2+N antenna elements, where N is one of zero or an odd integer;

(b) a switching circuit having a plurality of switches, each of said switches being connected to an associated different one of said antenna elements; and (c) a switch control circuit for causing said switching circuit to connect a selected single adjacent pair of said antenna elements to a receiver while maintaining any remaining antenna elements unconnected to the said receiver;

(d) wherein said antenna has an odd number of antenna elements;

(e) wherein each of said antenna elements is of square shape, the diagonals of all of said elements being directed in one or the other of two opposite directions.

11. The system of claim 10 wherein the time delay of a signal passing from one of said antenna elements to the switch connected thereto is substantially the same for each of said antenna elements.

12. The system of claim 10 wherein said antenna has M antenna elements, where M is a predetermined odd integer greater than 1, and the intersection of said diagonals of each of said antenna elements is disposed at a different vertex of an equilateral polygon having M sides.

* * * * *